United States Patent [19]

Guomundsson et al.

[11] Patent Number: 4,888,933

[45] Date of Patent: Dec. 26, 1989

[54] STRUCTURAL PANEL

[76] Inventors: Edgar Guomundsson, Vesturbergi 49; Oli J. Asmundsson, Depluholum 6, both of Reyjavik, Iceland

[21] Appl. No.: 252,935

[22] Filed: Apr. 10, 1981

[30] Foreign Application Priority Data

May 7, 1980 [IS] Iceland ..... 8015170

[51] Int. Cl.[4] ..... E04B 2/70

[52] U.S. Cl. ..... 52/779; 52/481; 52/780

[58] Field of Search ..... 52/407, 562, 426, 427, 52/481, 238.1, 241, 282, 779, 593, 780, 822, 821, 778, 568, ; 403/364; 46/17, 19, 31

[56] References Cited

U.S. PATENT DOCUMENTS

| | | | |
|---|---|---|---|
| 2,968,118 | 1/1961 | Paulson | 46/12 |
| 3,037,590 | 6/1962 | Pavlecka | 52/481 |
| 3,146,497 | 9/1964 | Short | 52/282 |
| 3,204,300 | 9/1965 | Hofmann | 403/364 |
| 3,290,846 | 12/1966 | Mader | 52/778 |

FOREIGN PATENT DOCUMENTS

| | | | |
|---|---|---|---|
| 1298440 | 7/1969 | Fed. Rep. of Germany | 46/31 |
| 788362 | 2/1958 | United Kingdom | 46/19 |

*Primary Examiner*—John E. Murtagh

*Attorney, Agent, or Firm*—Fleit, Jacobson, Cohn, Price, Holman & Stern

[57] ABSTRACT

A structural panel including a board (2) to form a surface (3) and a structural post (1) to provide strength, wherein the supporting post is located at the edge of the board and the bearing direction of the structural post is perpendicular to the board surface, and the board and the structural post are joined by means of a groove (4), where the joining direction of the groove is in the plane of the board and is perpendicular to the edge of the board. Such a structural panel may be used in house construction.

4 Claims, 3 Drawing Sheets

FIG.7.
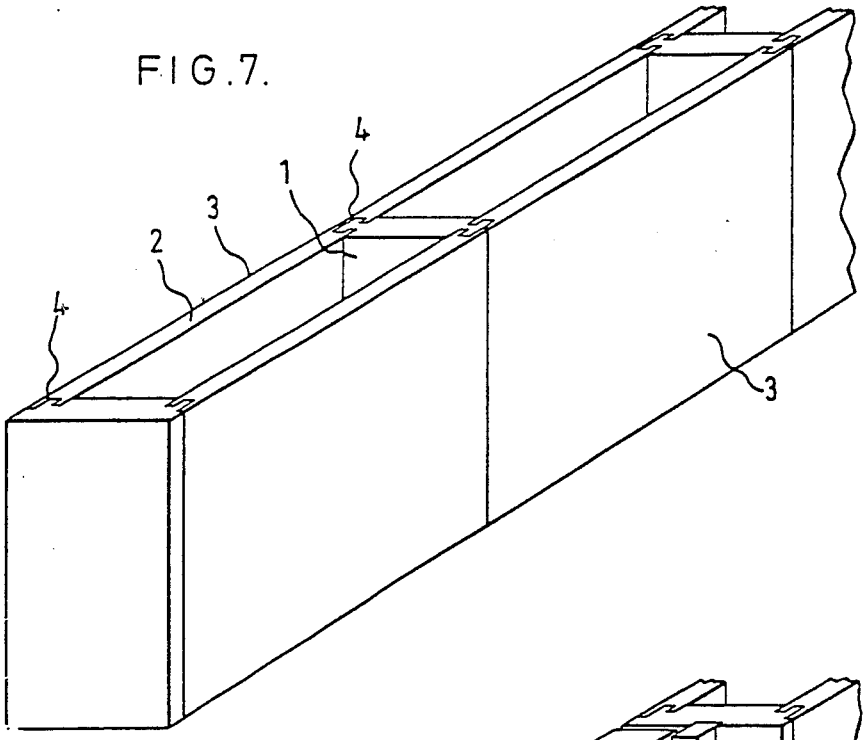
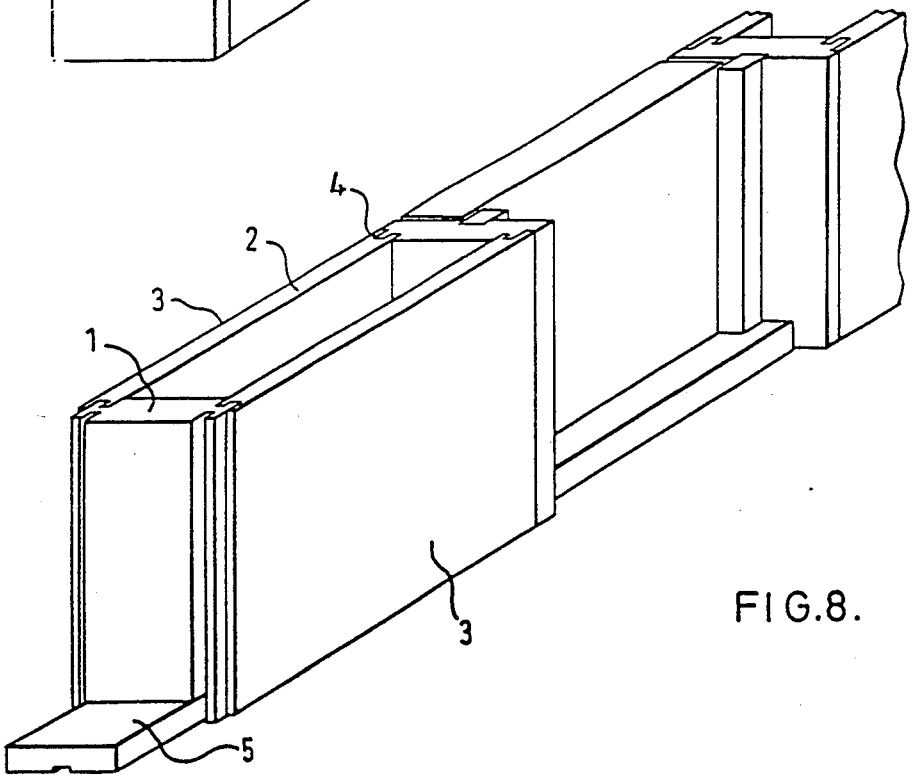
FIG.8.

STRUCTURAL PANEL

BACKGROUND OF THE INVENTION

1. Field of the Invention

The invention is a structural panel of wood consisting of a structural post and a building board locked together by means of a groove in the plane of the board so that the structural post and the adjacent boards form a bearing whole requiring no nailing, glueing, or other form of fastening, and can be snapped together and pulled apart easily and without professional skill.

Different kinds of structural posts form different kinds of structural panels, single or double, for instance conduits, floors, panelling on external walls, ceilings, insulated walls, complete walls, partial interior walls, or walls with windows or doors.

The basic units may be glued or fastened together to form larger units, increase strength or reduce material.

The invention is designed for house construction but can also be used in model building, toy making and elsewhere.

2. Description of the Prior Art

A plane is the most common form in house construction outside as well as inside. Walls, floors and ceilings, panelling on flat surfaces, permanent and movable interiors, and even furniture, are all build up from this simple form. Its unit is called a board.

The form by itself is not sufficient, for strength is also required. The board has least strength and rigidity in the direction of the perpendicular to its plane. In that direction it is flexible and weak. Therefore a structural frame is built behind the boards and the boards fastened to it, usually by nailing but also often by glueing. This kind of structural surface has no special name, and is in fact thought of as two distinct things, as a structural frame and the covering boards. The structural frame is a bearing whole and is constructed by itself ahead of the rest, since it must, among other things, sustain the hammering involved in nailing the boards onto it.

The structural frame must be adapted to the size of the board, since under each board edge there must be a post to carry the perpendicular thrust on the board and to fasten the board into. Therefore the construction of the frame calls for fairly accurate measurement. The structural posts must not bend from the straight line of the edge, and must therefore be braced so that each post forms a straight line. The construction of the frame therefore requires professional skill, practical sense, measurement, and a considerable amount of labor.

The boards are then nailed onto the frame and all nails set, which is a time-consuming job. All nail holes must be filled and the filler left to dry properly, after which it must be sanded down. Electric wires or conduits run vertically within walls, so that holes must be drilled in the braces to thread the conduits through. Door and window frames are not automatically produced but must be made separately and fastened to the frame. The result of all this is that two thirds of the cost of a wall without door or window frames is accounted for by the labor described above, consisting for the most part in measuring, nailing, and repairing the damage associated with nailing.

SUMMARY OF THE INVENTION

An object of the invention is to substantially reduce the labor required in constructing a structural panel. The purpose of measurement is to locate posts where two boards meet. This can be done by changing the order of operations and placing each post after the board is already in position, thus making the board determine the location of the post, which in turn determines the location of the next board. This makes measurement unnecessary.

The purpose of nailing is to fasten the board and the post together. Nailing is an immovable and permanent form of fastening which does not allow a seperation without some damage and even total damage. This kind of fastening is far from being desirable, since it is an indisputable advantage to be able to change interior arrangements. The reason for nailing must be that firm and separateable fastening does not exist. To replace nailing it is therefore necessary to invent such a fastening.

Grooving is a known method of joining that does not have the drawbacks of nailing but has nevertheless not been used to fasten board and post together. The groove has only been used to join surface units, as in plane joints, and then only to provide a character of continuity across the joint, provide continuity, and make the joint rigid in the plane of the surface, but not to fasten the surface-forming elements to structural elements. For that purpose nailing is used, even when the surface-forming elements are joined by means of a groove. Thus the groove is known only as a plane-joint, of constructing a surface of plane units, but not as a means of joining plane units and at the same time attaching them to a supporting frame nor as a means of simply attaching such units to a frame. All this may be summed up in the conclusion that the groove is known as a plane-joint. Another object of the invention is to make use of a groove as a structural frame joint or for joining individual structural posts to other structural members or, in other words, as a means of bearing joint.

A further object of the invention is to provide a structural panel which has the bearing characteristics of the structural frame and the surface characteristics of the board covering but instead of being based on glueing, nailing or any kind of permanent fastening is self-bracing and can be taken apart.

BRIEF DESCRIPTION OF THE DRAWINGS

FIG. 7 is a perspective view of a double structural panel with an end member forming a partial interior wall.

FIG. 8 is a perspective view of a double structural panel with a frame.

DESCRIPTION OF THE PREFERRED EMBODIMENTS

Figure 1:
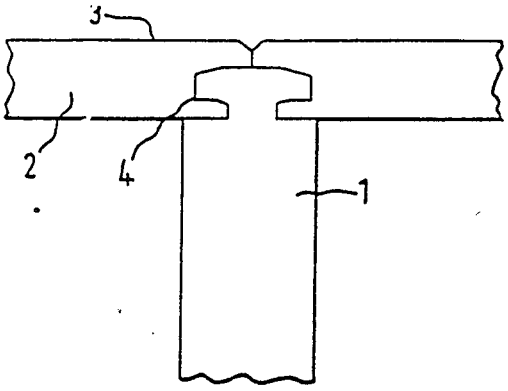
FIG. 1 is a plan view of a structural panel in accordance with the present invention.

The invention is a structural panel according to FIG. 1, including a board (2) to form a surface (3) and a structural post (1) to provide strength, where the supporting post (1) is located at the edge of the board (2) and the bearing direction of the structural post (1) is perpendicular to the board surface (3), and the board (2) and the structural post (1) are joined by means of a groove (4), where the joining direction of the groove (4) is in the plane of the board (3) and is perpendicular to the edge of the board.

Since an ordinary groove is a rigid joint in a direction perpendicular to the longitudinal direction and the direction of joining, in other words, at right angles to the surface, in the direction of the perpendicular to it, and the bearing direction of the supporting post (1) is directed in the direction of the perpendicular, the groove becomes a rigid joint or fastening in the bearing direction. Since the structural post (1) is rigid in the direction in which the board is flexible and is connected to it by a joint that is rigid in the same direction, the rigidity of the structural post (1) is transferred to the board (2), which thus becomes rigid both to and from the structural post (1), but that is precisely the function formerly served by nailing. This is the function of a "transverse" groove.

The "transverse" groove (4) thus does not function as a plane-joint, for it does not join two surface units, but instead joins a surface unit to a bearing unit, but that was formerly the function of nailing. The result is a bearing, surface-unit, a structural panel of this invention according to FIG. 1.

By joining the same structural post (1) to two boards (2) in the same plane, a plane joint is formed between the boards, where the structural post (1) is an intermediary member. Therefore the structural panel may be defined as a panel consisting of surface units joined by means of a groove and is characterized by, the groove-joint not being between the surface units, but between one surface units and a bearing intermediate member and then again between the same intermediate member and a second surface units, so that the groove-joint is indirect and the intermediate member a bearing one.

This does not necessarily include that the intermediate member becomes a part of the surface. On the other hand, if can be, if so desired. This is a matter of free choice, but not indispensable principle.

From structural panel units a surface may be constructed that is equivalent to an ordinary groove-joint surface but has the advantage of requiring neither nailing, glueing, nor a structural frame, since bearing ability and rigidity are included characteristics. This is a structural panel.

Theoretically a joining direction of a groove between the structural post (1) and the board can be either in the plane of the board or perpendicular to it, i.e. in the direction of the normal. In the latter case the groove is not fixed in the bearing direction of the structural post, which under a load becomes slightly bended, which would suffice to loosen the joint. Moreover, it does not utilize the surface strength of an ordinary chip board, which is one of the most common kinds of board used in house building, but instead it depends on the strength within the board, perpendicular to the surface, where such a board is weakest. For these two reasons a groove in the direction of the perpendicular to the plane of the board is unsuitable for the construction of a structural panel. Neither does such a groove resist a force in the direction away from the surface, caused, for instance, by a sudden drop in air pressure or by the weight of shelves or other things suspended from the surface. A groove in the plane of the board does bear such forces, it is fixed in the normal direction, which is a necessary condition for transferring the bearing ability from the structural post to the board, since that resistance is in that poopsite direction. In addition the groove allows the bending referred to above and also makes use of the surface strength of a chip board.

A structural panel according to the invention is assembled on the site by placing the supporting post (1) against the edge of the board (2), or vice versa, and locking the groove-joint by pressing the units together. This includes that the structural panel itself locates the structural post (1), and therefore a measurement is unnecessary. Since, moreover, the "transverse" groove serves the purpose of nailing, the labor involved in measuring and nailing the frame together, as well as in nailing and setting of nails, filling of nail holes, and sanding, is eliminated with the realization of this new structural panel.

The form and design of the groove depends on circumstances, such as the bearing qualities and thickness of the board and the desired character of the surface, whether, for instance, the structural post is to be concealed, visible between the boards, or aligned in the plane of the board. It is important that the groove is narrow enough to prevent moving of the board in the bearing direction in spite of natural shrinkage, but still wide enough to made assembly suitably easy and allow disassembly without damage.

Figure 2:
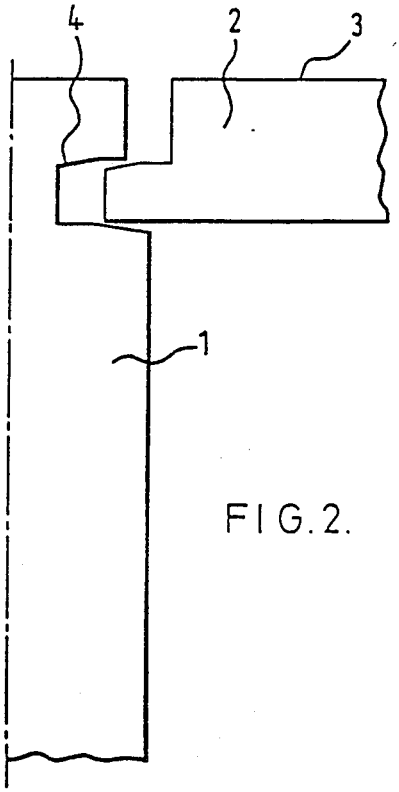
FIG. 2 is a partial plan view of the structural panel illustrating one embodiment of the post, board and groove arrangement.

These requirements are contrary, and consequently for that purpose the groove according to FIG. 2 is important, which allows for a two-stage assembly where the second stage involves two parallel contact surfaces on each side of the groove, which are not opposite each other and consequently exert a bending force on the tongue filling the groove. Such a groove utilizes the elasticity of the wood for the purpose of a firm hold in the groove. Furthermore, it allows for an amount of shrinkage in the locking direction of the groove corresponding to the length of the contact surfaces. Such a groove is called double if it has two contact surfaces and triple if it has three; furthermore, it is a "transverse" groove.

Figure 3:
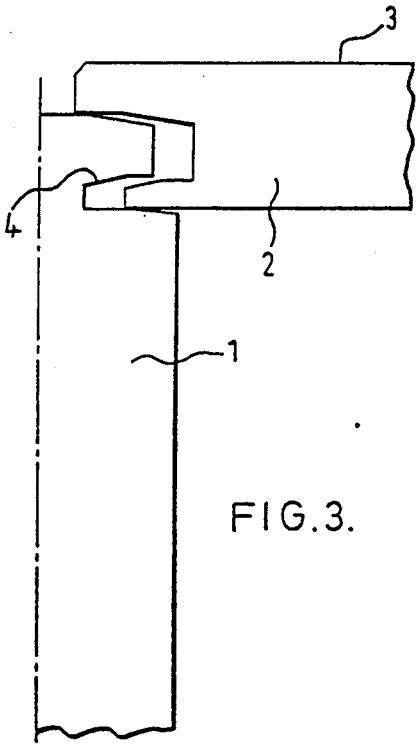
FIG. 3 is a partial plan view of another embodiment of the post, board and groove arrangement.

FIG. 3 shows a triple elastic "transverse" groove. Such a groove conceals the structural post under the surface of the boards.

Figure 4:
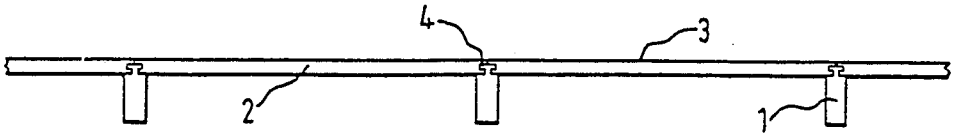
FIG. 4 is a plan view of a single structural panel constructed in accordance with the present invention.

FIG. 4 shows a single structural panel.

Figure 5:
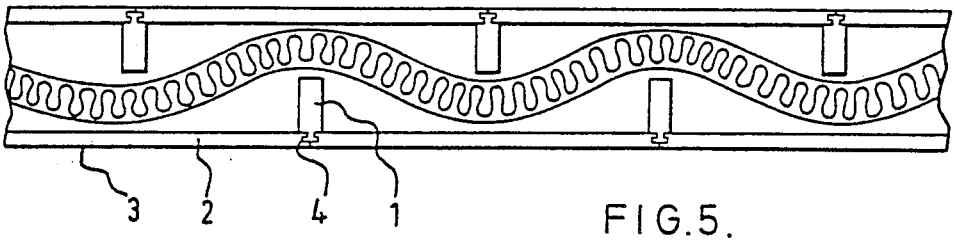
FIG. 5 is a plan view of two structural panels forming an insulating wall.

FIG. 5 shows two single structural panels forming an insulating wall.

Figure 6:
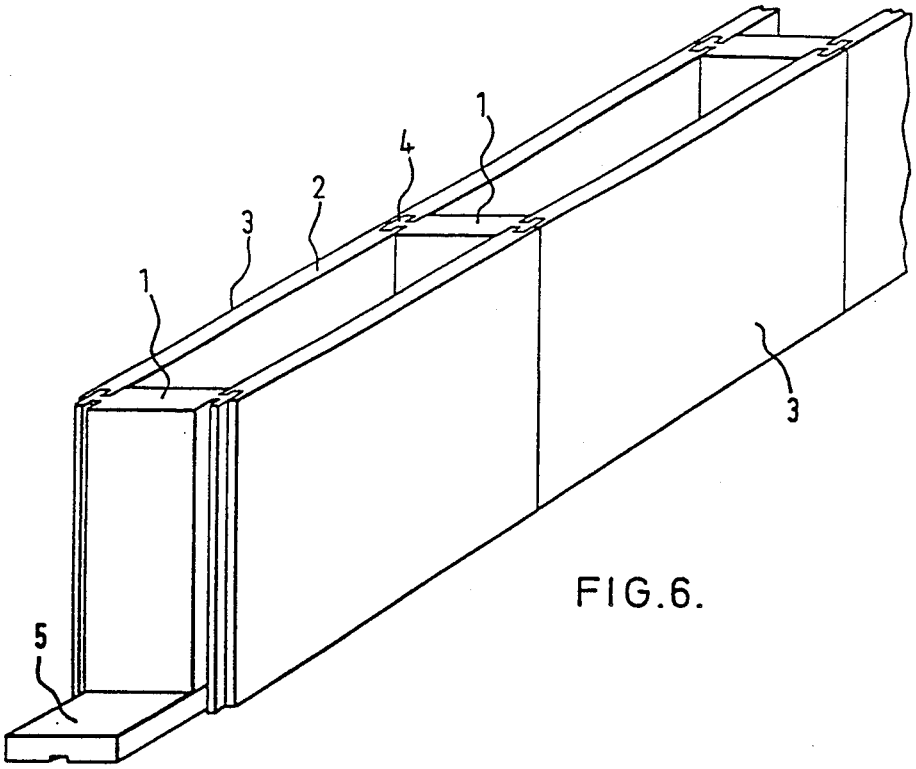
FIG. 6 is a perspective view of a double structural panel forming a complete interior wall.

FIG. 6 shows a double structural panel forming a complete interior wall.

FIG. 7 shows a double structural panel with an end member, forming a partial interior wall.

FIG. 8 shows a double structural panel with a frame.

The above description together with the accompanying drawings gives only an example of the application of the invention, made for the purpose of obtaining patent protection, and does not in any way limit the invention.

The inventors know, that the invention is applicable to other materials than wood, even though wood has here been chosen for the illustrative purpose already mentioned.

The assembled wholes according to FIGS. 4 to 8 are attached to other structures by means of a positioning piece (5) fastened by conventional nailing.

What is claimed as new is as follows:

1. A structural panel comprising a structural post together with a surface-board, where the structural post is located along the edge of the board, and the bearing direction of the structural post is perpendicular to the plane of the board, and is characterized by a transverse groove on the structural post and board, where the joining direction of the transverse grooves lies in the plane of the board and perpendicular to the joint when the grooves are frictionally grippingly engaged such that the units are joined necessarily and sufficiently to form a bearing whole, a structural panel, without nailing, and can thus with ease and without professional skill be snapped together, characterized by a triple elastic transverse groove including two contact surfaces on the tongue, these surfaces not being located opposite each other, and opposite each of these contact surfaces a corresponding contact surface in the groove, and in addition a third contact surface, not located opposite the nearer of the former two, and opposite to this third contact surface a corresponding contact surface on the other unit.

2. A structural panel according to claim 1, characterized by two of the three contact surfaces of the elastic transverse groove being at the edge of the board.

3. A structural panel comprising a post having opposed generally planar, parallel opposed surfaces interconnected by an edge, a transverse groove in at least one surface thereof, said groove being defined by a pair of walls extending inwardly from said one surface of the post and being spaced a substantial distance from the edge of the post, a board having generally planar surfaces interconnected by an edge with an edge portion of the board engaged with the groove in the post, said edge portion of the board and said groove in the post each including coacting means providing a structural interconnection by which the load bearing rigidity of the post is transferred to the board to produce a load bearing structural panel, said means in the groove in the post including a pair of contact surfaces frictionally grippingly engaging the means on the edge portion of the board, said contact surfaces being oriented in the walls of the groove to engage the edge portion of the board along surfaces spaced from the edge of the board and spaced inwardly from said one surface of the post, said contact surfaces in the walls of the groove being angulated flat surfaces, said means on the board also including angulated flat surfaces, said post including an identical groove in the other opposed surfaces thereof and a board having an edge portion engaged with each groove, said grooves being spaced from the edge of the post with the wall of each groove oriented closer to the edge of the post being shorter than the wall of the groove remote from the edge of the post, said means on each board including a groove defined by spaced walls extending inwardly from the edge of the board and including said angulated flat surfaces, one wall of the groove in the edge of the board overlying the edge of the post and being longer than the groove wall received in the groove in the post, the edge portions of the boards overlying the edge of the post being disposed in adjacent relation when the boards and post are assembled thereby substantially covering the edge of the post, the edge of the post including angulated flat surfaces cooperating with the angulated flat surfaces in the wall of the board groove for frictional gripping engagement, the shorter groove wall in the edge of the board engaging the shorter groove wall in the post groove, the longer groove wall in the post groove engaging the planar surface of the board remote from the edge portion of the board overlying the edge of the post.

4. The structural panel as defined in claim 3 wherein said post and boards are constructed of components having wood-like characteristics with substantial thickness, said angulated flat surfaces and grooves being dimensioned to frictionally grip opposing surfaces to retain the post and boards in assembled relation to form a structural panel without use of separate fastener arrangements.

* * * * *